United States Patent [19]

Sugimoto et al.

[11] Patent Number: 4,733,630

[45] Date of Patent: Mar. 29, 1988

[54] COATING THICKNESS REGULATING DEVICE FOR ELONGATE ARTICLE COATING SYSTEM

[75] Inventors: Yoshinobu Sugimoto; Yoshifumi Mizuguchi, both of Numazu, Japan

[73] Assignee: Yazaki Corporation, Japan

[21] Appl. No.: 829,602

[22] Filed: Feb. 14, 1986

[30] Foreign Application Priority Data

Feb. 15, 1985 [JP] Japan ..... 60-19029[U]
Feb. 15, 1985 [JP] Japan ..... 60-19030[U]
May 20, 1985 [JP] Japan ..... 60-73578[U]

[51] Int. Cl.[4] ..... B05C 11/02

[52] U.S. Cl. ..... 118/109; 118/125; 118/DIG. 18

[58] Field of Search ..... 118/109, 125, DIG. 18; 15/256.6

[56] References Cited

U.S. PATENT DOCUMENTS

| | | | |
|---|---|---|---|
| 1,754,190 | 4/1930 | Harris et al. | 118/109 X |
| 1,943,818 | 1/1934 | Fantone et al. | 118/125 |
| 2,229,071 | 1/1941 | Godstrey | 15/256.6 |
| 2,386,148 | 10/1945 | Smith | 118/DIG. 18 |
| 2,576,961 | 12/1951 | McCarthy | 118/DIG. 18 |
| 4,130,676 | 12/1978 | Ichiyanagi et al. | 427/358 |

FOREIGN PATENT DOCUMENTS 2024086 1/1980 United Kingdom .

*Primary Examiner*—John P. McIntosh
*Attorney, Agent, or Firm*—Lowe, Price, LeBlanc, Becker & Shur

[57] ABSTRACT

A coating thickness regulating device for regulating the thickness of the paint film coating an elongate article, such as a wire, a pipe or the like, in coating the elongate article by an elongate article coating system. The device comprises a spreading block having a cavity consisting of a cylindrical section and a taper section, an outlet opening, an inlet opening and through holes opening into the cavity; a spreading element formed of a nonwoven web formed by laminating webs of elastic and abrasion-resistant fibers, such as stainless steel fibers and/or copper alloy fibers, and packed in the cavity of the spreading block so as to receive and pass a coated elongate article therethrough; and pressing means for adjustably compressing the spreading element so that the coated elongate article is passed properly through the spreading element to form a uniform paint film having a desired thickness over the surface of the elongate article.

15 Claims, 10 Drawing Figures

COATING THICKNESS REGULATING DEVICE FOR ELONGATE ARTICLE COATING SYSTEM

BACKGROUND OF THE INVENTION

The present invention relates to an elongate article coating system for paint coating elongate articles, such as wires, pipes,string-like matters or the like and more specifically to a coating thickness regulating device for such a system, for regulating the thickness of the paint applied to the surface of an elongate article.

It has been a common practice to employ, in order to apply paint continuously to the outer surface of an elongate article in a uniform thickness, a process in which the elongate article is immersed and passed through paint contained in a container to coat the elongate article with the paint, and then the coated elongate article is passed through a spreading die, a spreading cloth or felt while the paint is fresh to remove the excessive paint from the elongate article so that the elongate article is coated with a paint film having a comparatively uniform thickness.

However, passing the coated elongate article through a spreading die has the following disadvantages.

First, since an ordinary spreading die is made of a rigid material, such as a metal, and is provided with a spreading hole having a fixed diameter, the variation of the elongate article in diameter causes a variation of the coating in thickness, which results in unsatisfactory coating due to the variation of the drying rate and hardening rate of the coating; secondly, when foreign matters, such as dust, are contained in the paint, the foreign matters scratch the coating to flaw the coating with stripes, or, sometimes, break the elongate article when the elongate article is very slender; thirdly, water paint and oil paint containing an organic solvent tends to collect and harden in the vicinity of the inlet of the spreading die and scratch and flaw the coating; and fourthly, ordinarily, the elongate article is aligned with the spreading die before starting the coating operation in order to form a uniform clearance between the inner circumference of the spreading hole of the spreading die and the outer circumference of the elongate article, however, the elongate article tends to deviate from the correct position and the clearance tends to vary due to the vibration of the elongate article during the coating operation, which provides a paint film having irregular thickness.

Cloth and felt have a flexible and porous structure consisting of natural fibers and/or synthetic fibers each having a low elastic limit and a low abrasion resistance, and hence a spreading cloth or felt is capable of being easily brought into close contact with the surface of the elongate matter. However, a spreading cloth or felt is abraded rapidly causing irregular spreading. Accordingly, a coating thickness regulating device employing cloth or felt as spreading means is unable to operate continuously for an extended period of time under optimum operating conditions.

In order to overcome such disadvantages of a spreading cloth or felt, in a known method, the spreading cloth or felt is impregnated with a suitable amount of paint and packed in a spreading block by applying an appropriate external pressure thereto. However, since cloth and felt have a low elastic limit, the collapse of the voids of the porous structure occurs particularly in the portion near the surface of the running elongate article, and thereby the paint retaining function of the spreading cloth or felt is deteriorated; therefore, it is very difficult to maintain the spreading cloth or felt in an optimum spreading condition and to adjust the packing pressure properly. On the other hand, the abrasion of the portion of the spreading cloth or felt extending around the elongate article increases with increase in the packing pressure. The abraded spreading cloth or felt causes irregular coating and scratches in the paint film. Excessively thick coatings are liable to be dried futilely and, in some cases, are peeled off the elongate article to form uncoated portions in the surface of the elongate article. Uncoated portions are liable to be formed at the start of the coating operation or when the paint is not supplied sufficiently to the immersing process. The uncoated portions increase the friction between the elongate article and the surface of the spreading cloth or felt, which can break the elongate article.

SUMMARY OF THE INVENTION

The present invention has been made in view of the above-mentioned disadvantages of the conventional spreading die and the spreading cloth and felt devices. Accordingly, it is an object of the present invention to provide a coating thickness regulating device for an elongate article coating system which eliminates the disadvantages of the known coating thickness regulating devices and is capable of regulating the thickness of the coating of paint applied to an elongate article at a desired thickness through an extended period of the elongate article coating operation.

The above and other objects, features and advantages of the present invention will become more apparent from the description of the preferred embodiment thereof taken in conjunction with the accompanying drawings.

DESCRIPTION OF THE PREFERRED EMBODIMENTS

Figure 1:
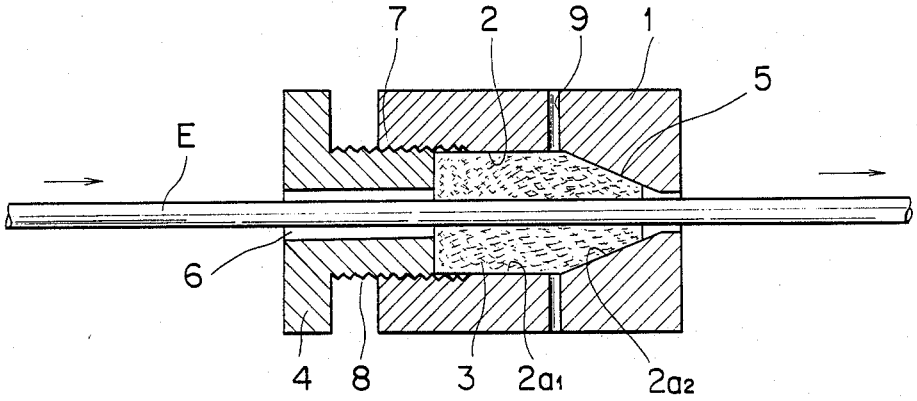
FIG. 1 is a sectional side elevation of a coating thickness regulating device, in a first embodiment, according to the present invention.
Figure 2:
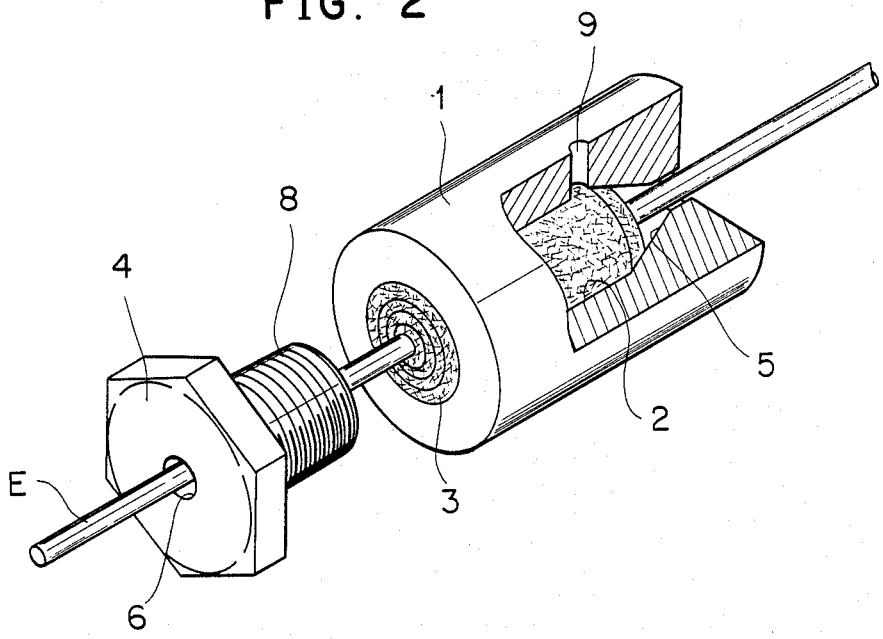
FIG. 2 is a partly cutaway and partly exploded perspective view of the coating thickness regulating device of FIG. 1.

Referring to FIGS. 1 and 2, a coating thickness regulating device, in a first embodiment, according to the present invention, comprises a spreading block 1 having a cavity 2 for receiving an elongate article E therethrough, a spreading element 3 formed of a nonwoven Fabric of elastic and abrasion-resistant fibers and packed in the cavity 2, and a pierced plug 4 for variably adjusting the compression of the spreading element 3. The cavity 2 has an internally threaded inlet section, a cylindrical intermediate section $2a_1$ and a tapered outlet section $2a_2$. An internal thread 7 is formed in the inlet section. The pieced plug 4 has a threaded portion 8 which engages the internally threaded inlet section of the cavity 2, and a central hole 6 for receiving the elongate article E therethrough. The pierced plug 4 may be a bolt having a hole formed along the center axis thereof. The pieced plug 4 is screwed on the spreading block 1 so as to compress the spreading element properly. Through holes 9 are formed in the spreading block 1 to discharge the paint scraped off from the elongate article E and collected in the cavity 2 therethrough and to return the discharged paint to the preceding coating process.

The nonwoven fabric forming the spreading element 3 is formed by laminating webs of elastic and abrasion-resistant fibers, such as stainless steel fibers or copper alloy fibers, having a suitable length and a diameter less than 20μ, preferably, less than 10μ. The component fibers of the nonwoven fabric are entangled with each other to form a highly elastic structure having numerous voids. Accordingly, when pressure is applied to the spreading element 3 formed of such a nonwoven fabric, the spreading element 3 is compressed without loosing the voids, and hence the paint retaining property of the spreading element 3 is maintained. Furthermore, since the spreading element 3 is flexible and elastic, the spreading element never damages the surface of the elongate article E when pressed closely to the same.

Figure 6:
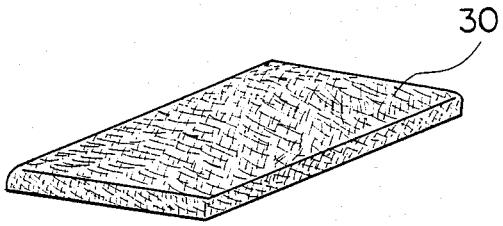
FIG. 6 is a perspective view of a piece of a nonwoven fabric employed in the coating thickness regulating device of the present invention; and FIGS. *7a, 7b, 7c* and *7d* are perspective views showing exemplary manners of passing an elongate article through a spreading element.
Figure 7A:
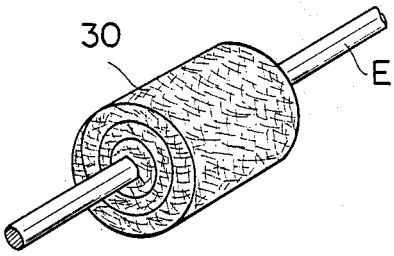
Figure 7B:
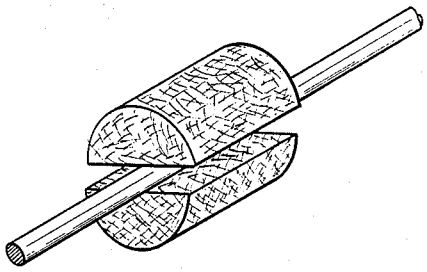
Figure 7C:
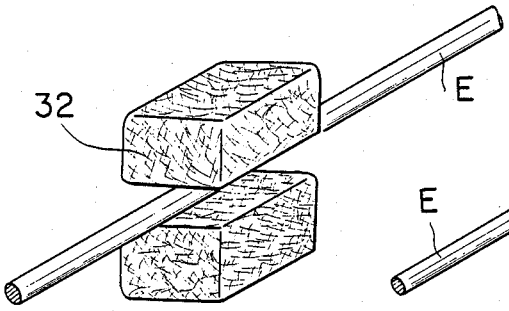

The spreading element 3 may be formed by cutting the nonwoven web as illustrated in FIG. 6 into a strip 30 and winding the strip 30 around the elongate article E as illustrated in FIG. 7*a*, by cutting the nonwoven fabric into a pair of semicylindrical pieces 31 and placing the semicylindrical pieces 31 on opposite sides of the elongate article E, respectively, as illustrated in FIG. 7*b*, or by cutting the nonwoven fabric into a pair of rectangular pieces 32 and placing the rectangular pieces 32 on opposite sides of the elongate matter E, respectively, as illustrated in FIG. 7*c*.

The spreading element 3 thus formed is pushed into the cavity 2 and then the pierced plug 4 is screwed into the cavity 2 through an appropriate distance so that the spreading element 3 is compressed properly.

In operation, paint is applied to the surface of the elongate article E in the preceding process by dipping or other means, then the coated elongate article E is passed through the center hole 6 of the plug 4, and then the coated elongate article E is drawn out continuously in the direction of the arrows (FIG. 1) from the the spreading block 1 while the same is passed through the spreading element 3 packed in the cavity 2 to remove the excessive paint from the coated elongate article E. The excessive paint is absorbed by the spreading element 3 and is retained within the numerous voids of the spreading element. Thus the elongate article E is coated with a uniform paint film having a thickness of several microns to several tens of microns when drawn out from the spreading block 1.

Since the cavity 2 has the tapered outlet section $2a_2$, the spreading element 3 is compressed uniformly and optionally by screwing the plug 4 into the cavity 2 to adjust the contact pressure of the spreading element on the elongate article E properly so that the elongate article E will be coated with a paint film having a desired thickness. When the excessive paint absorbed by the spreading element 3 and retained in the voids is collected to the full retaining capacity of the spreading element 3, the paint collected in the cavity 2 is extracted by suction or the like and is returned to the preceding coating process.

A coating thickness regulating device, in a second embodiment, according to the present invention will be described hereinafter with reference to FIGS. 3 and 4.

The coating thickness regulating device comprises a split spreading block 11 consisting of an upper block part 11*a* and a lower block part 11*b* and having a cavity 12 for receiving an elongate article E therethrough, a push ring 14 axially slidably fitted in the cavity 12, a spreading element 15 formed of a nonwoven Fabric consisting of elastic and abrasion-resistant fibers and packed in the cavity 12, a slotted sleeve 18 having an axial slot 21 for receiving the elongate article E therethrough into the center hole 20 thereof and a projection 22, a pneumatic cylinder 19 for compressing the spreading element 15 through the slotted sleeve 18 and the push ring 14, and a base plate 26 mounted with the lower block part 11*b* and the pneumatic cylinder 19.

The cavity 12 has a cylindrical inlet section, a cylindrical intermediate section and a taper outlet section 13. The spreading element 15 is received in the cylindrical intermediate section and the tapered outlet section 13. A guide groove 23 is formed in the bottom surface of the cylindrical inlet section of the cavity 12 to guide the projection 22 of the slotted sleeve 18 so that the slotted sleeve 18 is guided and slidable in the cavity 12.

The upper block part 11*a* is separated from and joined to the lower block part 11*b* by a joining mechanism, not shown. Complementary semicylindrical recesses 12*a* and 12*b*, and complementary semiconical recesses 13*a* and 13*b* are formed in the upper block part 11*a* and the lower block part 11*b*, respectively. The complementary semicylindrical recesses 12*a* and 12*b* and the complementary semiconical recesses 13*a* and 13*b* form the cavity 12 when the upper block part 11*a* and the lower block part 11*b* are joined together. Through holes 25 are formed through the upper block part 11*a*, the lower block part 11*b* and the base plate 26 so as to open into the tapered outlet section 13 of the cavity 12.

The push ring 14 consists of an upper piece 14*a* and a lower piece 14*b* which are retained in the upper semicylindrical recess 13*a* and in the lower semicylindrical recess 13*b* with retaining plates 17 screwed to the upper block 11*a* and to the lower block 11*b*, respectively. When the upper block 11*a* and the lower block 11*b* are joined together, a hole for receiving the elongate article E therethrough is formed between the upper piece 14*a* and lower piece 14*b*. The push ring 14 partitions the cavity 12 into two sections.

The spreading element 15 is packed in the cylindrical intermediate section and the tapered outlet section 13. In the second embodiment, the spreading element 15 consists of an upper element 15*a* and a lower element 15*b*, which are packed in the upper block part 11*a* and in the lower block part 11*b* and retained therein with the retaining plates 17, respectively. Hooks or the like may be employed instead of the retaining plates 17, for slidably retaining the upper piece part 14*a* and the lower piece part 14*b* of the push ring 14 and the upper element 15*a* and the lower element 15*b* of the spreading element 15.

The slotted sleeve 18 has a center through hole 20 for passing the elongate article E therethrough and is slidably fitted in the cylindrical section of the cavity 12.

The pneumatic cylinder 19 is disposed so that the free end of the piston rod 24 is in contact with the projection 22 of the slotted sleeve 18. When actuated, the pneumatic cylinder applies a pressure through the slotted sleeve 18 and the push ring 14 to the spreading element 15. The pneumatic cylinder 19 may be substituted by screw means capable of pushing the slotted sleeve 18.

Figure 7D:
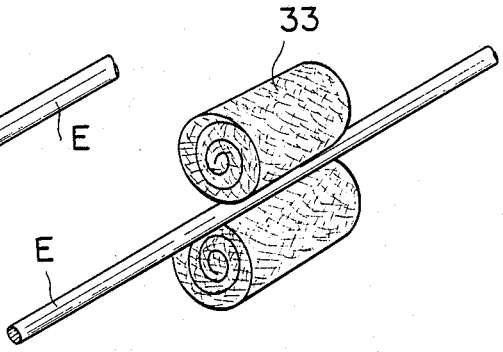

The spreading element 15 is formed of the same nonwoven fabric as that employed in forming the spreading element 2 of the first embodiment. The upper element 15*a* and the lower element 15*b* of the spreading element 15 each may be formed by cutting the nonwoven fabric as illustrated in FIG. 6 into a strip 30 and winding the strip 30 in a cylindrical roll 33 as illustrated in FIG. 7*a*, by cutting the nonwoven fabric 30 into a semicylindrical piece 31 as illustrated in FIG. 7*b*, or by cutting the nonwoven fabric 30 into a rectangular piece 32 as illustrated in FIG. 7*c*. Furthermore, a nonwoven fabric formed by laminating a plurlaity of webs having different void ratios, respectively, may be used for forming the spreading element 15 as illustrated in FIG. 7*d*.

In operation, the elongate article E coated with paint in the preceding process by dipping or the like means is passed, while the paint is still fresh, through the through hole 20 of the slotted sleeve 18, the center hole 16 of the push ring 14 and the spreading element 15 packed in the intermediate section and the tapered outlet section of the cavity 12 and is drawn continuously out of the spreading block 11 in the direction of the arrow (FIG. 4) while being passed through the spreading element 15. Thus, the excessive paint coating is scraped off from the elongate article E, absorbed by the spreading element 15 and is retained in the voids of the spreading element 15, so that the elongate article E is coated with a uniform paint film having a thickness, for example, in the range of several microns to several tens of microns, when drawn out from the coating thickness regulating device. A uniform pressure is applied through the slotted sleeve 18 and the push ring 14 to the spreading element 15 so that the spreading element 15 is compressed in the cavity properly. The compression of the spreading element 15 can be adjusted optionally by adjusting the pressure of the compressed air supplied to the pneumatic cylinder 19. The spreading element 15 is compressed so that an appropriate spreading pressure is applied to the coated elongate article E by the spreading element 15, and thereby the elongate article E is coated with a paint film having a desired film thickness.

A coating thickness regulating device, in a third embodiment, according to the present invention will be described hereinafter with reference to FIG. 5.

This coating thickness regulating device is equipped with two coating thickness regulating units A and B of the same construction. The coating thickness regulating units A and B are capable of being shifted between a working position and a resting position, and are used alternately, namely, when the coating thickness regulating unit A is positioned at the working position, the coating thickness regulating unit B is positioned at the resting position and, when the coating thickness regulating unit A is positioned at the resting position, the coating thickness regulating unit B is positioned at the working position. Since the coating thickness regulating units A and B have the same construction, the description of one of them will be sufficient, and hence only the coating thickness regulating unit A will be described herein and the description of the other will be omitted for simplicity.

The coating thickness regulating unit A comprises a spreading head 40 including a split spreading block 11, a pneumatic cylinder 19, a stand 50 supporting the spreading head 40, a sliding table 60 mounted with the stand 50, a bed 70 slidably supporting the sliding table 60, an upper base plate 26*a* joined to the upper block part 11*a* of the split spreading block 11 and associated with the stand 50 so as to be vertically slidable along guide rails 51 formed in the stand 50, and a lower base plate 26*b* supporting the lower block 11*b* of the split spreading block 11.

Figure 3:
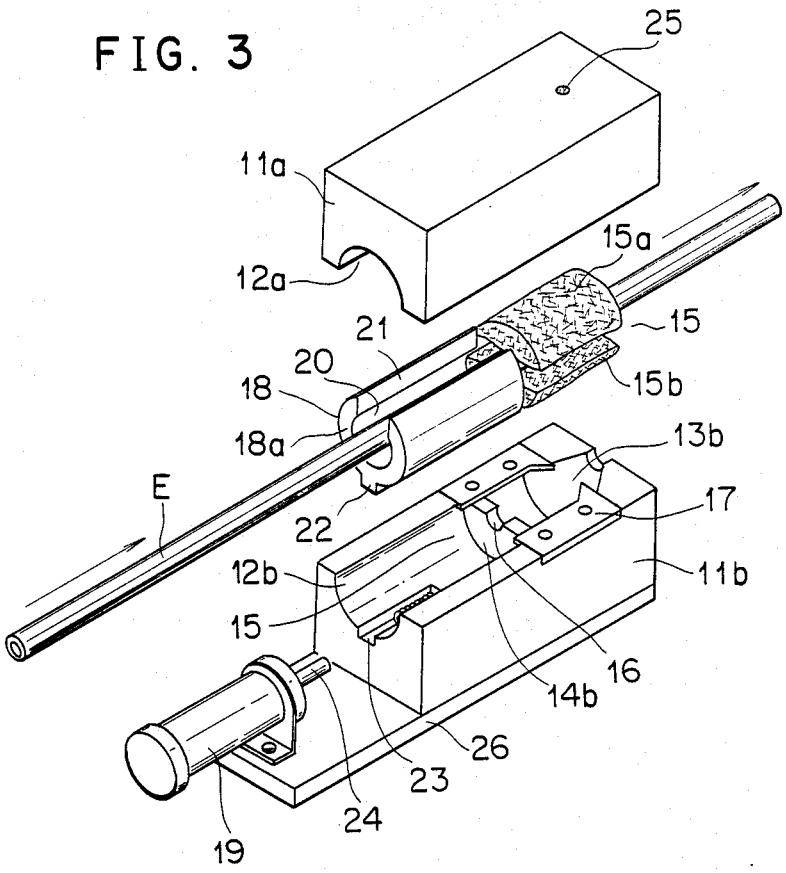
FIG. 3 is an exploded perspective view of a coating thickness regulating device, in a second embodiment, according to the present invention.
Figure 4:
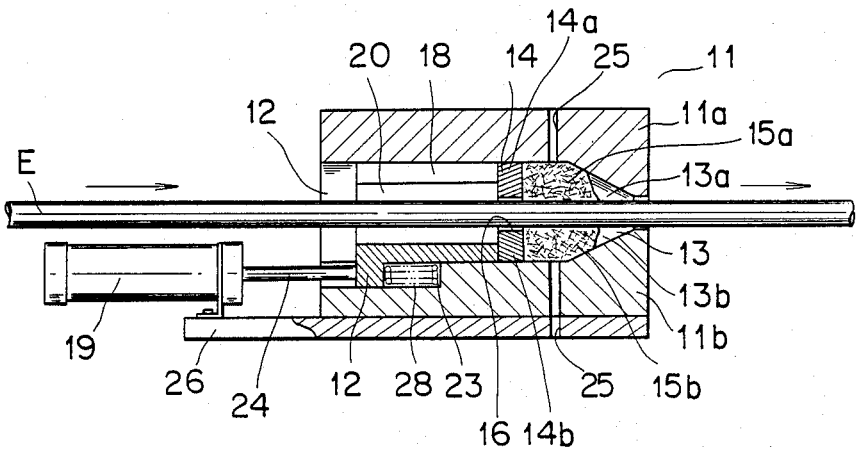
FIG. 4 is a sectional side elevation of the coating thickness regulating device of FIG. 3.

The spreading head 40 has substantially the same construction as that of the coating thickness regulating device of the second embodiment shown in FIGS. 3 and 4. That is, the spreading head 40 comprises the split spreading block 11 consisting of the upper block part 11*a* and the lower block part 11*b* and having a cavity 12 for receiving an elongate article E therethrough, a push ring 14 axially slidably fitted in the cavity 12, a spreading element 15 formed of a nonwoven fabric consisting of elastic and abrasion-resistant fibers and packed in the cavity 12, a slotted sleeve 18 having an axial slot 21 for receiving the elongate article E therethrough in the axial center hole 20 thereof and a projection 22, a pneumatic cylinder 19 for compressing the spreading element 15 through the slotted sleeve 18 and the push ring 14, and a compression coil spring 28 provided in an axial groove 23 so as to bias the slotted sleeve 18 outward.

The cavity 12 has a cylindrical inlet section, a cylindrical intermediate section and a tapered outlet section 13. The spreading element 15 is received in the cylindrical intermediate section and the tapered outlet section 13. The guide groove 23 is formed in the bottom surface of the cylindrical inlet section of the cavity 12 to guide the projection 22 of the slotted sleeve 18 so that the slotted sleeve 18 is guided and slidable in the cavity 12.

Complementary semicylindrical recesses 12*a* and 12*b*, and complementary semiconical recesses 13*a* and 13*b* are formed in the upper block part 11*a* and the lower block part 11*b*, respectively. The complementary semicylindrical recesses 12*a* and 12*b* and the complementary semiconical recesses 13*a* and 13*b* form the cavity 12 when the upper block part 11*a* and the lower block part 11*b* are joined together. Through holes 25 are formed through the upper block part 11*a* and the upper base plate 26*a*, and through the lower block 11*b* and the lower base plate 26*b* so as to open into the tapered outlet section 13 of the cavity 12. The upper block part 11*a* is joined to the upper base plate 26*a*, while the lower block part 11*b* is joined to the lower base plate 26*b*. The upper block part 11*a* and the lower block part 11*b* are supported on the stand 50 and are interlocked by a rack-and-pinion mechanism (not shown) so that the upper base plate 26*a* and the lower base plate 26*b* can be moved slidably along the guide rails 51 of the stand 50 to move the upper block part 11*a* and the lower block part 11*b* away from and toward each other.

The sliding table 60 mounted with the stand 50 is provided on the bed 70 and is movable by suitable means (not shown) between the working position and the resting position. In FIG. 5, the coating thickness regulating unit A is located at the working position while the coating thickness regulating unit B is located at the resting position. In order to move the coating thickness regulating unit from the working position to the resting position, the coating thickness regulating unit is shifted laterally away from the passage of the elongate article E. In FIG. 5, the upper block part 11a and the lower block part 11b of the coating thickness regulating unit B are separated from each other to prepare the coating thickness regulating unit B for operation.

The push ring 14 consists of an upper piece 14a and a lower piece 14b which are retained in the upper block part 11a and the lower block part 11b with retaining plates 17 screwed to the upper block part 11a and the lower block part 11b, respectively. The push ring 14 partitions the cavity 12 into two sections.

The spreading element 15 is packed in the cylindrical intermediate section and the tapered outlet section 13 of the cavity 12 in front of the push ring 14. The spreading element 15 consists of an upper element 15a and a lower element 15b, which are packed in the upper block part 11a and the lower block part 11b and are retained therein with the retaining plates 17, respectively. The upper element 15a and the lower element 15b are the same as those employed in the second embodiment.

The pneumatic cylinder 19 is disposed so that the free end of the piston rod 24 thereof is in contact with the projection 22 of the slotted sleeve 18. When actuated, the pneumatic cylinder 19 pushes the slotted sleeve 18 against the resilient resistance of the compression spring 28 to compress the spreading element 15 through the slotted sleeve 18 and the push ring 14. When the pneumatic cylinder 19 is de-energized, the compression coil spring 28 pushes the slotted sleeve 18 toward the pneumatic cylinder 19 to allow the spreading element to expand.

The spreading element 15 is formed of the same nonwoven fabric as those employed in forming the spreading elements 2 and 15 of the first and second embodiments.

Figure 5:
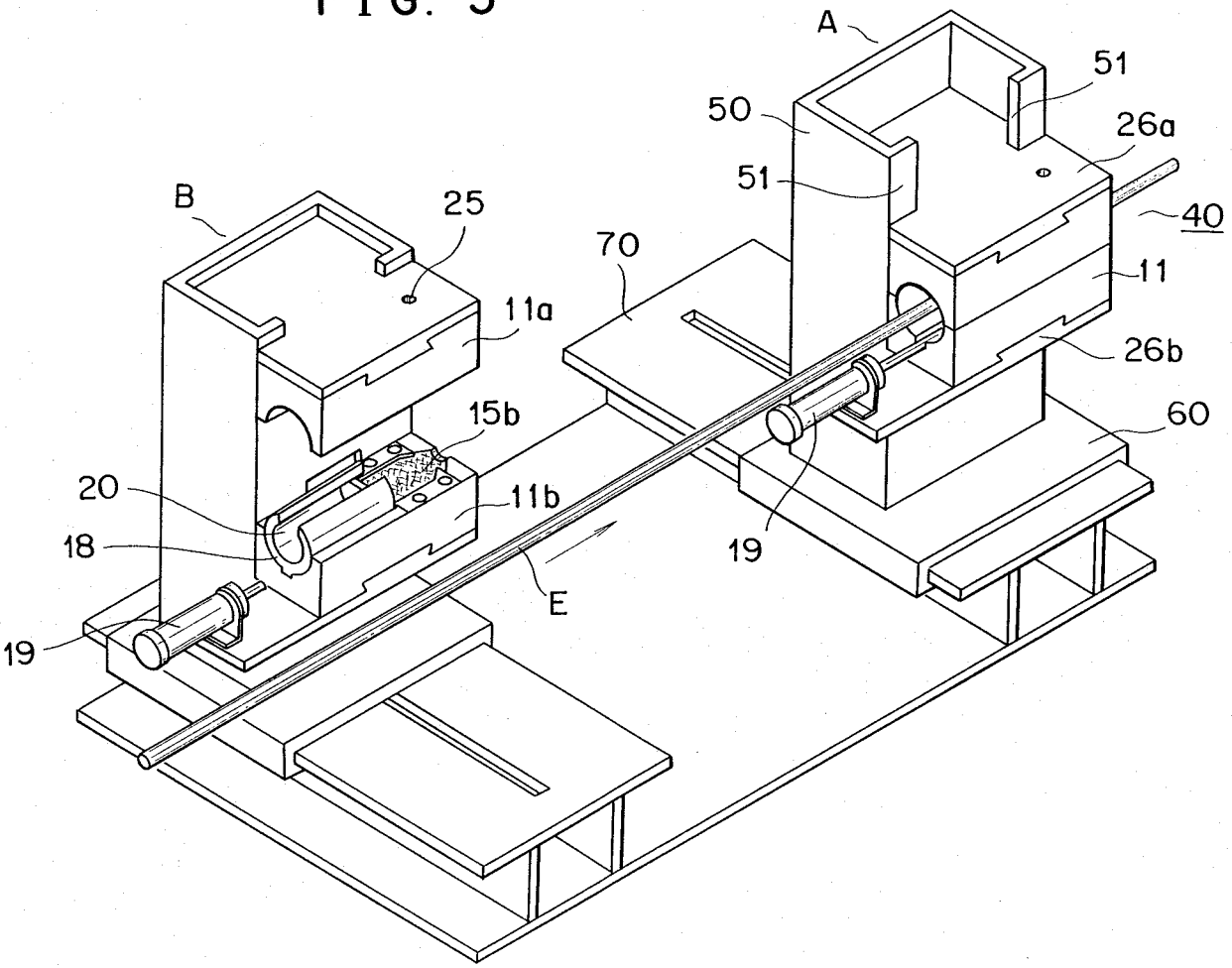
FIG. 5 is a perspective view of a coating thickness regulating device, in a third embodiment, according to the present invention.

In operation, either the coating thickness regulating unit A or B is located at the resting position, namely, the position of the coating thickness regulating unit B in FIG. 5, the spreading block 11 is opened by moving the upper block part 11a and the lower block part 11b away from each other, and then a new upper element 15a and a new lower element 15b are put in the upper block part 11a and the lower block part 11b, respectively. Then, the coating thickness regulating unit thus prepared is moved to the working position, namely, the position of the coating thickness regulating unit A in FIG. 5, where the coating thickness regulating head 40 is aligned with the passage of the elongate material E, and then the upper block part 11a and the lower block 11b are moved toward each other to close the split spreading block 11 with the elongate article E received therebetween.

The elongate article coated with paint in the preceding process, not shown, by dipping or the like means enters the coating thickness regulating head 40 from the inlet side (left-hand side as viewed in FIG. 5) of the same, passes through the center hole 20 of the slotted sleeve 18, the center hole 16 of the push ring 14 and the spreading element 15, and then the elongate article E is drawn out of the coating thickness regulating head 40. While the elongate article E passes through the coating thickness regulating head, the coated elongate article E is passed through the spreading element 15 to remove the excessive paint coating the elongate article E. The excessive paint thus removed from the elongate article E is absorbed by the spreading element 15 and is retained in the voids of the spreading element 15. The slotted sleeve 18 is pressed by the pneumatic cylinder 19 to compress the spreading element 15 packed in the cavity 12. Since the cavity 12 has a tapered outlet section 13, the spreading element 15 is compressed in both the axial direction and the radial direction when the slotted sleeve 18 is pressed by the pneumatic cylinder 19, so that the spreading element 15 is pressed firmly to the elongate article E. The compression of the spreading element 15 is greater in the tapered outlet section 13 than in the cylindrical intermediate section of the cavity 12. When the pressure applied to the pneumatic cylinder 19 is reduced, the slotted sleeve 18 is moved toward the inlet side by the action of the expansion coil spring 28, and thereby the spreading element 15 is allowed to expand owing to its own elasticity to increase the void ratio. Thus, the contact pressure of the spreading element 15 on the elongate article E and the void ratio of the spreading element 15 can be adjusted to regulate the coating thickness by adjusting the pressure applied to the pneumatic cylinder 19. The paint absorbed and retained by the spreading element 15 moves to insufficiently coated portions of the elongate article E, and thereby the elongate article E is coated with paint uniformly.

Furthermore, since the dust contained in the paint coating the elongate article E is caught by the spreading element 15, the elongate article E is coated always with a flawless and uniform paint film.

Still further, since the third embodiment of the present invention has the two coating thickness regulating units A and B, and the coating thickness regulating units A and B can be located at the respective working positions alternately without interrupting the elongate article coating operation and the coating thickness regulating operation, the elongate article coating system can be operated continuously for an extended period of time.

As apparent from the foregoing description of the preferred embodiments, the present invention has the following advantages:

(1) The thickness of the paint film coating the elongate article can be optionally and easily controlled with high reproducibility by simply and properly adjusting the compression of the elastic and abrasion-resistant spreading element by adjusting the screwing degree of the pierced plug or the air pressure to be applied to the pneumatic cylinder, which has been difficult in the conventional coating thickness regulating device employing a spreading die of a spreading element formed of cloth or felt;

(2) The elastic and abrasion-resistant spreading element is capable of being compressed uniformly and the voids facing the elongate article do not collapse when the spreading element is compressed, therefore, the elongate article is coated uniformly even if the surface thereof is irregular, and hence the elongate article can be coated with a uniform paint film;

(3) Since increase in the resistance of the spreading element against the running of the elongate article due to the collapse of the voids in the spreading element does not occur and the spreading element is highly abrasion-resistant, the coating thickness regulating device can be operated continuously for an extended period of time;

(4) Dust contained in the paint applied to the elongate article in the dipping process is caught by a portion of the spreading element with which the coated elongate article first comes into contact and the dust is never brought to a portion of the spreading element packed in the tapered outlet section of the cavity where the final coating condition is regulated;

(5) When the elongate article in process is changed for another elongate article having a different size or when the paint is changed for another paint, the arrangement of the coating thickness regulating device can be changed simply by changing the spreading element; and (6) The paint wiped off the coated elongate article and collected in the cavity of the spreading block can be discharged by suction or by like means and returned to the preceding coating process; therefore, the paint is always circulated through the spreading element to prevent the paint from hardening within the spreading element.

Although the invention has been described in its preferred form with a certain degree of particularity, it is to be understood that many changes and variations are possible in the invention without departing from the scope and spirit thereof.

What is claimed is:

1. A coating thickness regulating device in an elongate article coating system, comprising a block having a cavity therewithin having openings at opposite ends thereof, said cavity including a straight inlet section and tapered outlet section to permit passage of said elongate article coated with fresh paint thereon and traveling longitudinally therethrough, said coated elongate article extending from outside said block through said straight inlet section and through said tapered outlet section to outside said block;

a nonwoven metal fabric of elastic and abrasion-resistant fiber packed within said cavity to wrap said coated elongate article; and means for compressing said nonwoven metal fabric from the straight inlet section toward the tapered outlet section.

2. A coating thickness regulating device according to claim 1, wherein said block is a unitary member.

3. A coating thickness regulating device according to claim 1, wherein said block includes a pair of block parts.

4. A coating thickness regulating device according to claim 1, wherein said straight inlet section of the cavity is cylindrical.

5. A coating thickness regulating device according to claim 4, wherein said straight inlet section is internally threaded, said compression means including a threaded plug to be screwed into the straight inlet section.

6. A coating thickness regulating device according to claim 4, wherein said compressing means includes a pair of push ring parts inserted into the straight inlet section to surround said elongate article on an inlet side of the nonwoven metal fabric, a sleeve inserted into the straight inlet section on an inlet side of said push ring parts and a pneumatic cylinder provided outside the block opposite the straight inlet section, said pneumatic cylinder having a rod abutting against the sleeve.

7. A coating thickness regulating device according to claim 1 wherein said block is formed with at least one hole in communication with the cavity.

8. A coating thickness regulating device according to claim 1, wherein the nonwoven metal fabric is made of elastic and abrasion-resistant fiber comprises stainless steel fibers.

9. A coating thickness regulating device according to claim 1, wherein the nonwoven metal fabric is made of elastic and abrasion-resistant fiber comprises copper alloy fibers.

10. A coating thickness regulating device in an elongate article coating system, comprising a path along which an elongate article coated with fresh paint may travel longitudinally;

at least two coating thickness regulating units along said path, each unit being adapted to move toward and away from said elongate article alternately to take a working position and resting position;

each unit including a pair of block parts adapted to move toward and away from each other for assembly and disassembly, each block part having a complimentary recess to define a single cavity when said block parts are assembled, said cavity being adapted to accommodate said elongated article at said working position; and said each unit further including a nonwoven metal fabric of elastic and abrasion-resistant fiber packed within said cavity to wrap said elongate article.

11. A coating thickness regulating device according to claim 10, wherein said cavity includes a straight inlet section and a tapered outlet section.

12. A coating thickness regulating device according to claim 11, wherein said straight inlet section is cylindrical

13. A coating thickness regulating device according to claim 12, further including means for compressing said nonwoven metal fabric from the straight inlet section toward the tapered outlet section.

14. A coating thickness regulating device according to claim 13, wherein said compressing means includes a pair of push ring parts inserted into the straight inlet section to surround the elongate article on an inlet side of the nonwoven metal fabric, a sleeve inserted into the straight inlet section on an inlet side of the push ring parts and a pneumatic cylinder provided outside the block parts opposite the straight inlet section, said pneumatic cylinder having a rod abutting against the sleeve.

15. A coating thickness regulating device according to claim 14, wherein at least one of said block parts is formed with at least one hole in communication with the cavity.

* * * * *